US010113697B2

(12) United States Patent
Cuche

(10) Patent No.: US 10,113,697 B2
(45) Date of Patent: Oct. 30, 2018

(54) BULB FOR A MOTOR VEHICLE LAMP

(71) Applicant: GRUPO ANTOLIN BESANCON, Besancon (FR)

(72) Inventor: Remy Cuche, Quingey (FR)

(73) Assignee: GRUPO ANTOLIN BESANCON, Besancon (FR)

( * ) Notice: Subject to any disclaimer, the term of this patent is extended or adjusted under 35 U.S.C. 154(b) by 0 days.

(21) Appl. No.: 15/623,809

(22) Filed: Jun. 15, 2017

(65) Prior Publication Data

US 2017/0363255 A1 Dec. 21, 2017

(51) Int. Cl.

| | |
|---|---|
| ***F21K 9/235*** | (2016.01) |
| ***F21K 9/238*** | (2016.01) |
| ***F21K 9/232*** | (2016.01) |
| ***F21V 23/00*** | (2015.01) |
| ***F21V 23/06*** | (2006.01) |
| ***F21S 43/00*** | (2018.01) |
| *F21Y 115/10* | (2016.01) |

(52) U.S. Cl.

CPC ..... *F21K 9/235* (2016.08); *F21K 9/232* (2016.08); *F21K 9/238* (2016.08); *F21S 43/00* (2018.01); *F21V 23/003* (2013.01); *F21V 23/06* (2013.01); *F21Y 2115/10* (2016.08)

(58) Field of Classification Search

CPC ..... F21K 9/235; F21K 9/238; F21K 9/232; F21V 23/003; F21V 23/06; F21S 43/00; F21Y 2115/10

See application file for complete search history.

(56) References Cited

U.S. PATENT DOCUMENTS 4,051,360 A * 9/1977 Slater, Jr. ..... F21S 43/51 362/363
2005/0030761 A1 2/2005 Burgess
2015/0092426 A1 4/2015 Brink

FOREIGN PATENT DOCUMENTS

WO 2015/012084 A1 1/2015

OTHER PUBLICATIONS

"Wedge Base" at www.wikipedia.org.

* cited by examiner

*Primary Examiner* — Tracie Y Green

(74) *Attorney, Agent, or Firm* — Andrew W. Chu; Craft Chu PLLC

(57) ABSTRACT

The bulb for an automobile vehicle lamp includes a body having a housing making at least one compartment for housing an electronic card on which is mounted at least one light-emitting diode, and an end-piece, connected to the housing. The end-piece is laid out for defining a cap able to cooperate with a socket for a bulb of the «wedge base T10» type. The bulb includes an electric connection for the light-emitting diode to an electric circuit of the lamp. The body and electric connection are defined by independent parts coupled together and including additional fittings.

11 Claims, 1 Drawing Sheet

BULB FOR A MOTOR VEHICLE LAMP

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a bulb for an automobile vehicle lamp, including a body having a housing, making at least one compartment for housing an electronic card on which is mounted at least one light-emitting diode, and an end-piece, connected to said housing, said end-piece being laid out for defining a cap able to cooperate with a socket for a bulb of the «wedge base T10» type, said bulb also including electrical means for connection of said light-emitting diode with the electric circuit of said lamp.

2. Description of Related Art Including Information Disclosed Under 37 CFR 1.97 and 37 CFR 1.98

Because of the low electric consumption of light-emitting diodes (LEDs), of their significant lifetime and of their advantageous properties in terms of electric safety, it is today recommended to use, instead of traditional bulbs, for example of the filament or halogen type, including in the field of automobile vehicle lamps, «LED bulbs». Conventionally, the latter have a structure in which at least one electronic card, on which is soldered at least one light-emitting diode, is encapsulated inside a container for example in plastic, or in glass, extending with a terminal portion or an end-piece acting as a cap capable of cooperating with a socket. Thus, many LED bulb models are presently found on the market, which differ from each other not only by the shape of the container, the type of material used for making the latter, or its color, but also by the shape of the terminal portion provided to be compatible with the different socket formats or supports of traditional bulbs existing presently.

Thus, in the field of bulbs for automobile vehicle lamps, such as notably a pilot light, a ceiling light, a door bottom lamp, etc., more particularly targeted by the present invention, there also exist to this day many products based on LEDs which may be substituted for traditional bulbs. These products generally consist of several parts in plastic material supporting one or several printed circuits, while the electric connection of the LEDs is achieved by means of welded metal pins on the printed circuits and folded back around a terminal portion defining a cap.

BRIEF SUMMARY OF THE INVENTION

The object of the present invention is to propose a new LED bulb able to be substituted for a conventional bulb of the «wedge base T10» type, which has a simpler structure than the similar products presently offered for sale, so as to reduce the production cost, which is particularly robust and which further gives the possibility of making an electric connection as a «lamp clamp» with greater flexibility.

For this purpose, the invention relates to a bulb for an automobile vehicle lamp of the kind indicated in the preamble, characterized by the fact that said body and said electric connection means are defined with coupled independent parts and include additional fitting means.

According to a preferential embodiment alternative, said body is made in one piece in a plastic material.

Moreover, the bulb according to the invention is further characterized in that said housing includes a bottom for which the lower face is extended by said end-piece and the upper face is bordered with at least two opposite side walls, extending in a plane perpendicular to the insertion plane of said end-piece in the socket, and between which said electronic card extends parallel to said bottom, while said electric connection means include two identical metal members, formed from a cutout and folded metal plate each having an upper portion provided with an arm for maintaining it in position and with connection arms intended to be engaged through additional orifices which each side wall of said housing includes for respectively ensuring a blocking in position on said body and coming into contact with said electronic card, each metal member further having a lower portion, having a connection strip for which the structure is laid out for fitting at least one portion of said end-piece.

Moreover, the orifices through which the connection arms and the position maintaining arms are intended to be engaged, are preferentially distributed in an area wherein each side wall includes a recess on its external face.

Another characteristic of the invention is further defined by the fact that said connection arms and said position-maintaining arms of each metal member are extended with a rear face, perpendicular to the plane in which they extend, connecting them to said connection strip, and able to come and be housed in said recess when said metal member and said body are coupled with each other.

The invention also provides that the bottom of said housing includes two grooves each opening onto a longitudinal slot formed in each of said side walls, each of said grooves being laid out for receiving and guiding in translation a positioning tab which each metal member includes.

Moreover, according to a preferential embodiment alternative of said bulb, said housing includes at least a pair of grooves formed facing each other on the internal face of each side wall for receiving the opposite edges of at least one electronic card.

Another characteristic of the invention is further defined by the fact that said housing includes an upper wall surmounting both lateral walls of said housing, and laid out, if necessary, for defining or receiving a distribution means towards different directions of the light radiation emitted by the LED.

The present invention further provides that said body is at least partly made in a transparent, tinted or diffusing plastic material.

Further, the invention is also characterized in that said housing may include an electronic card for controlling said LED.

Other features and advantages of the invention will become apparent from the detailed description which follows relating to an embodiment of the connection device, only given as an indication and not as a limitation.

BRIEF DESCRIPTION OF THE SEVERAL VIEWS OF THE DRAWINGS

The understanding of this description will be facilitated with reference to the enclosed drawings.

DETAILED DESCRIPTION OF THE INVENTION

Figure 1:
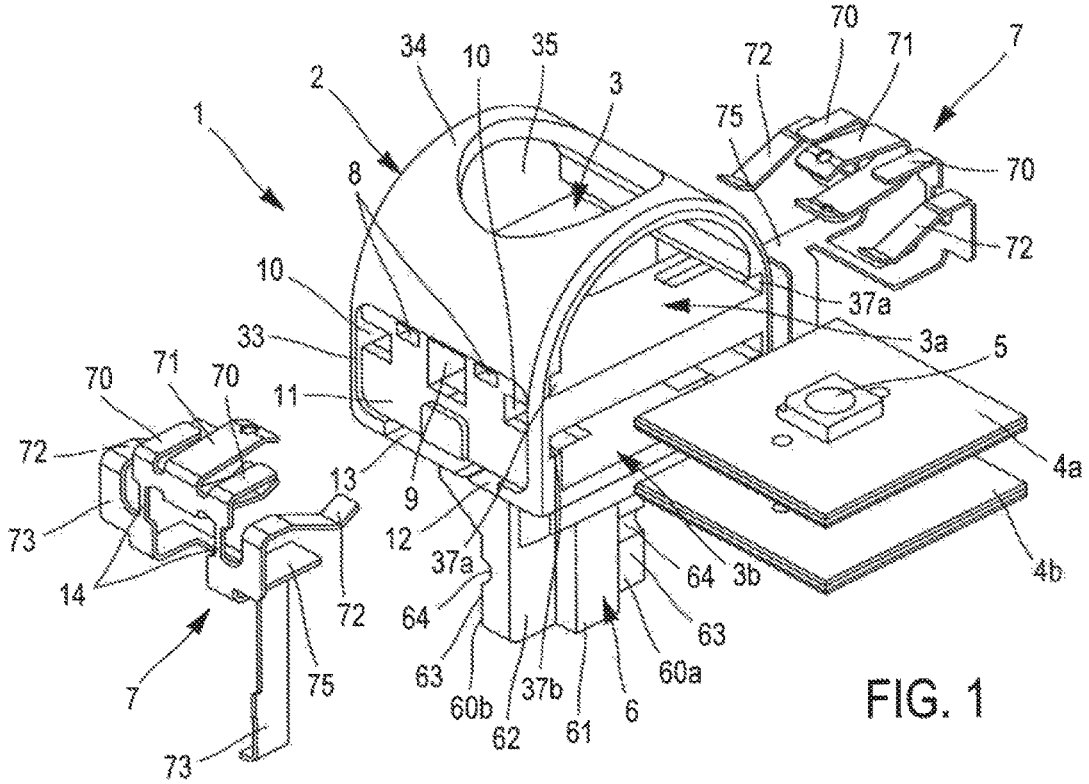
FIG. 1 corresponds to an exploded perspective view of a bulb according to the invention.
Figure 2:
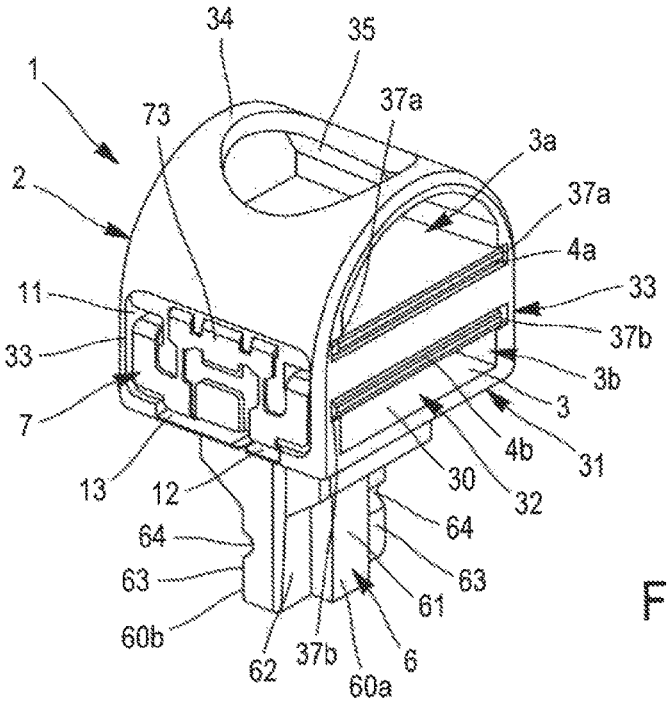
FIG. 2 is a perspective view that corresponds to the perspective view of the bulb of FIG. 1.

The object of the present invention is a LED bulb 1 for an automobile vehicle lamp, such as for example a ceiling lamp or a pilot lamp, etc, conventionally having a format of a lamp of the «wedge base T10» type lamp. With reference to the figures, and according to the invention, such a bulb 1 includes a body 2, preferably made in one piece in a suitable plastic material, at least partly transparent, tinted or diffusing, according to the desired type of illumination. The body 2 has a housing 3 divided into a first and second superposed compartments 3*a*, 3*b*. The latter are respectively able to receive an electronic card 4*a* on which is mounted a light-emitting diode (LED) 5 (upper compartment 3*a*), and an electronic card 4*b* intended for controlling the LED 5 (lower compartment 3*b*). The body 2 of the bulb 1 moreover includes an end-piece 6, located in the extension of the lower compartment 3*b*, and configured for defining a cap able to cooperate with a socket for a bulb of the «wedge base T10» type. Moreover, the bulb 1 includes a pair of identical metal members 7 giving the possibility of ensuring the electric connection of said LED 5, and adapted so as to be fitted on the body 2 and the electronic cards 4*a*, 4*b*, as this will be described in more detail hereafter.

In fact, according to the invention, the housing 3 of the body 2 includes a bottom 30 the lower face 31 of which is extended by the end-piece 6 and the upper face is bordered with two opposite side walls 33. The latter extend in a plane perpendicular to the plane for inserting the end-piece 6 into a socket for a bulb of the «wedge base T10» type, and are surmounted, in the illustrated embodiment alternative, with an upper wall 34 with a curved shape having a central aperture 35 able to receive, if necessary, a distribution means towards different directions of the light radiation emitted by the LED 5. The housing moreover includes an intermediate wall 36 parallel to the bottom 30, extending between the latter and the upper wall 35. Thus, the upper compartment 3*a* is delimited by the upper wall 35, the intermediate wall 36 and the two side walls 33, while the lower compartment 3*b* is delimited by the intermediate wall 36, both side walls 33 and the bottom 30. Moreover, each compartment 3*a*, 3*b* has a pair of grooves 37*a*, 37*b* formed facing each other on the internal face of each side wall 33 for receiving and supporting the opposite edges of the respective electronic cards 4*a*, 4*b*.

As illustrated in the figures, the end-piece 6 has a substantially Y shaped section, the rectilinear branch of which includes two opposite faces 60*a*, 60*b* symmetrical relatively to the longitudinal axis of the end-piece 6. In fact, each face 60*a*, 60*b* includes a central strip 61 in raised/recessed portions relatively to two end areas 62, 63 bordering it. The end area 62 has a planar surface, while the end area 63 includes a notch 64 with an axis parallel to the bottom 30 of the housing 3 adapted for cooperating with electric connection elements with which a socket of the «wedge base T10» type is provided in a conventional way, when the bulb 1 and said socket are fitted together.

Moreover, according to the invention, each metal member 7 is formed from a cutout and folded metal plate so as to have an upper portion provided with position-maintaining arms 70 and with connection arms 71, 72 intended to be respectively engaged through additional orifices 8, 9, 10, which each side wall 33 of the housing 3 includes and which are preferentially distributed in an area wherein each side wall includes a recess 11 on its external face. Each metal member 7 further has a lower portion, having a connection strip 73, the structure of which is laid out for fitting at least one portion of the end-piece 6 and more specifically, for resting against the end area 62 with a planar surface of one of its faces 60*a*, 60*b*. Further, the structure of each metal member 7 is provided so that the connection arms 71, 72 and the position-maintaining arms 70 are extended with a rear face, perpendicular to the plane in which they extend, connecting them to the connection strip 73, and able to come and be housed in the recess 11 when the metal member 7 and the body 2 are coupled together. Each metal member 7 also has a positioning tab 75 able to be received and guided in translation in a groove 12 of a corresponding shape opening onto a longitudinal slot 13 formed in one of said side walls 33 of the housing 3.

As this clearly emerges from the foregoing, the bulb 1 according to the invention has both a very simple, compact and robust structure, without any protruding elements, which rest on a single fitting of a few independent parts in one piece without any weakened areas which may have a negative incidence on their lifetime. More particularly, the assembly of the different constitutive portions of the bulb 1 according to the invention is very rapid to achieve since it simply consists of inserting the edges of the electronic card(s) 4*a*, 4*b* into the corresponding grooves 37*a*, 37*b*, by providing the positioning of the electronic card 4*a* bearing the LED 5 in the upper compartment 3*a*, so that the LED 5 is located facing the upper wall 34 of the housing 3, and then fitting both metal members 7 on the body 2.

As this was mentioned earlier, this last step consists, for each connection member 7, of introducing the position-maintaining arms 70 and the connection arms 71, 72 into the orifices 8, 9, 10 while the positioning tab 75 is slid into the corresponding groove 12, before pushing the assembly towards the compartments 3*a*, 3*b* until the rear face 74 of the metal member 7 rests in a recess 11 of a side wall 33 of the housing 3. The correct positioning of a metal member 7 is facilitated by the cooperation between the positioning tab 75 and the groove 12. Once in position, each metal member 7 remains clipped onto the body 2 by means of its position-maintaining tabs 70, while the electric connection between the electric circuit of the lamp receiving the bulb 1 and the electronic cards 4*a*, 4*b* is achieved through connection arms 71, 72 which advantageously define connection areas by elastic contact with either one of the electronic cards 4*a*, 4*b*, not requiring any soldering spot which may break over time.

Moreover, each metal member 7 is designed so as to also give the possibility of the electric connection between two electronic cards 4*a*, 4*b*, in the case of electronic control of the LED 5, like in the illustrated embodiment alternative, without requiring specific additional connection means. Separation areas 14 by cutting of electric bridges (unshuntings) are moreover provided for performing the different conceivable control modes (resistive with the electronic card 4*a* bearing the LED 5 alone, or electronic mode when the electronic card 4*a* bearing the LED 5 is coupled with an electronic card 4*b* bearing electronics for controlling the LED 5).

Thus, the objects set by the present invention are achieved and the bulb 1 which has just been described is both with a simplified manufacturing and therefore of reduced cost, with easy use and improved lifetime, while providing the possibility of providing different types of illumination according to the conventionally proposed range on the market in the same field.

I claim:

1. A bulb for an automobile vehicle lamp, comprising:

a body having a housing making at least one compartment, and an electronic card housed in said at least one compartment, said electronic card having at least one light-emitting diode mounted on said electronic card, and an end-piece, connected to said housing, said end-piece defining a cap cooperative with a socket for a bulb, said bulb being comprised of an electric connection means of said light-emitting diode with an electric circuit, wherein said body and said electric connection means are defined by independent coupled parts and additional fitting means.

2. The bulb, according to claim 1, wherein said body is comprised of one piece in a plastic material.

3. The bulb, according to claim 1, wherein said housing is comprised of a bottom having a lower face extended with said end piece and an upper face bordered with at least two opposite side walls, extending in a plane perpendicular to an insertion plane of said end-piece into a socket, wherein said electronic card extends parallel to said bottom and between said at least two opposite side walls, and wherein said electric connection means comprised two identical metal members, formed from a cutout and folded metal plate, each metal member having an upper portion provided with position-maintaining arms and connection arms engaged through additional orifices which each side wall of said housing includes for respectively ensuring a blocking in position on said body and coming into contact with said electronic card, each metal member further having a lower portion, having a connection strip the structure of which is laid out for fitting at least one portion of said end-piece.

4. The bulb, according to claim 3, wherein said additional orifices are distributed in an area wherein each side wall is comprised of a recess on respective external face.

5. The bulb, according to claim 4, wherein said connection arms and said position-maintaining arms of each metal member are extended with a rear face, perpendicular to a plane in which they extend, connecting them to said connection strip, and able to come and be housed in said recess when said metal member and said body are coupled together.

6. The bulb, according to claim 3, wherein said bottom of said housing comprises two grooves, each groove opening onto a longitudinal slot formed in each of said side walls, each of said grooves being laid out for receiving and guiding in translation a positioning tab which each metal member includes.

7. The bulb, according to claim 3, wherein said housing comprises at least a pair of grooves formed facing each other on the internal face of each side wall for receiving the opposite edges of at least one electronic card.

8. The bulb, according to claim 1, wherein said body is comprised of a transparent, tinted or diffusing plastic material.

9. The bulb, according to claim 1, wherein said housing further comprises an upper wall surmounting both side walls of said housing.

10. The bulb, according to claim 9, wherein said upper wall is laid out for defining or receiving a distribution means towards different directions of the light radiation emitted by the LED.

11. The bulb, according to claim 1, wherein said housing comprises an electronic control card of said LED.

* * * * *